US005249439A

United States Patent [19]

Fučík et al.

[11] Patent Number: 5,249,439

[45] Date of Patent: Oct. 5, 1993

[54] TAKE-OFF DEVICE HAVING RADIAL GROOVES FOR CIRCULAR KNITTING MACHINES

[75] Inventors: Milan Fučík, Kojetica na Moravě; Miroslav Chrom, Rokytnice n/Rok; Jiří Pohořilský Třebíč, all of Czechoslovakia

[73] Assignee: Uniplet a.s., Trebic, Czechoslovakia

[21] Appl. No.: 694,794

[22] Filed: May 2, 1991

[30] Foreign Application Priority Data

May 22, 1990 [CS] Czechoslovakia ..... 2485-90

[51] Int. Cl.[5] ..... D04B 15/88

[52] U.S. Cl. ..... 66/153

[58] Field of Search ..... 66/147, 148, 149 R, 66/149 S, 150, 151, 153, 152

[56] References Cited

U.S. PATENT DOCUMENTS

| | | | |
|---|---|---|---|
| 1,307,358 | 6/1919 | Houseman | 66/153 |
| 2,521,258 | 9/1950 | Semotan | 66/150 |
| 2,644,325 | 7/1953 | Hanes, Jr. et al. | 66/153 |
| 3,003,342 | 10/1961 | Kent et al. | 66/153 |
| 3,417,581 | 12/1968 | Docekal et al. | 66/147 |

FOREIGN PATENT DOCUMENTS

| | | | |
|---|---|---|---|
| 95445 | 11/1983 | European Pat. Off. | 66/147 |
| 432233 | 7/1935 | United Kingdom | 66/147 |
| 1577474 | 10/1980 | United Kingdom | 66/150 |

OTHER PUBLICATIONS

"Czechoslovkia, Recent Patent", *The Hosiery Trade Journal*, vol. 80, No. 960, Dec. 1973, p. 132.

*Primary Examiner*—Clifford D. Crowder
*Assistant Examiner*—Larry D. Worrell
*Attorney, Agent, or Firm*—Notaro & Michalos

[57] ABSTRACT

A device used on circular knitting machines for manufacturing hosiery or like knitwear, comprises two coaxial discs arranged adjacent each other so as to form a passage for a knitwork. One disc is provided with a helical surface for engaging the knitwork which is forced toward the helical surface by the second disc. One disc is rotatable while the other is stationary. Radial grooves are provided on the second disc for guiding the knitwork in the wale direction.

5 Claims, 2 Drawing Sheets

TAKE-OFF DEVICE HAVING RADIAL GROOVES FOR CIRCULAR KNITTING MACHINES

BACKGROUND OF THE INVENTION

1. Field of the Invention

The invention relates to a take-off device for circular knitting machines for manufacturing hosiery or like knitwear, comprising two discs mated so as to lead knitwork therebetween, of which one is provided with a helical surface to engage the knitwork which is forced to said surface by the second disc, one of said discs being rotatable while the other is stationary.

2. Description of the Related Art

The above take-off device has been designed for being used on well-known double-cylinder machines for manufacturing hosiery in jacquard, purl, rib patterns as well as in combinations thereof. If manufacturing ribbed fabrics, particularly in 4:2, 5:2 divisions, i.e. if using more adjacent lower needles, a helix causes the knitwork wales to cease their vertical orientation and to twist also helically. This drawback causes problems in the subsequent manipulation and finishing.

SUMMARY OF THE INVENTION

It is an object of the present invention to eliminate the disadvantage as hereinabove referred to substantially in that the second disc is provided on its surface facing the first disc with the helical surface with radial grooves for guiding the knitwork in the wale direction.

An advantage of the invention consists in that the knitwork leaves the machine with straight wales, i.e. not helically twisted, so that it can be easily manipulated in subsequent finishing steps.

Further, due to the fact that the radial grooves are provided on that surface which faces the helical surface, or that said radial grooves are provided downstream of the helical surface in the knitwork takeoff direction, various structural embodiments to correspond either to great-diameter, or small-diameter needle cylinders are preferably available.

Further, since each of the radial grooves has two edges, of which one is slowly sloping in the direction opposite the needle cylinder rotation while the other is substantially perpendicular to the disc surface, it is ensured that the knitwork is being gradually forced into the groove whereupon the perpendicular edge warrants the straight knitwork course in the wale direction.

Finally, due to the fact that the number of radial grooves corresponds to the number of the needles, each of the knitwork wales is guided practically in the vertical direction.

BRIEF DESCRIPTION OF THE DRAWINGS

In order that the present invention be better understood and carried into practice, some preferred embodiments thereof will hereinafter be described with reference to accompanying schematic drawings in which.

DESCRIPTION OF THE PREFERRED EMBODIMENTS

Figure 1:
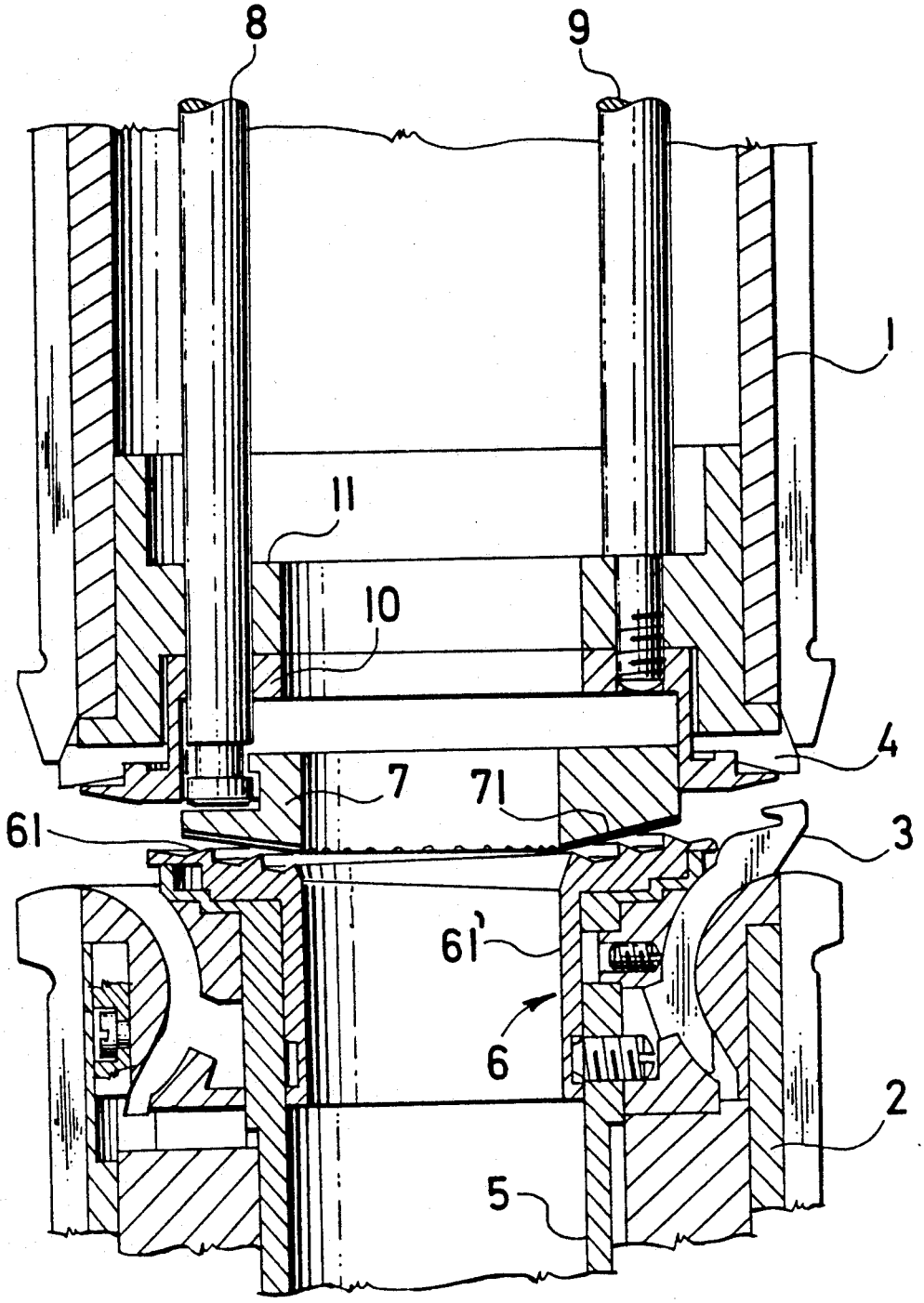
FIG. 1 is an axial sectional view of needle cylinders together with the take-off device.

As it is known, a double-cylinder circular knitting machine for manufacturing hosiery comprises an upper and a lower needle cylinder 1 and 2, respectively, in which double-head needles (not shown) together with sinkers for controlling them are mounted. The needles are controlled by knock-over sinkers 3 and by pressing sinkers 4 to form a knitwork which is then withdrawn by a mechanical take-off device consisting of the following elements.

To a stationary take-off tube 5 in the lower needle cylinder 2 there is secured a lower take-off disc 6 having the form of a funnel and being provided on its upper front portion with a helical surface 61. With said disc 6 is associated an upper take-off disc 7 which has the form of a ring and is fixedly attached to vertical rods 8. The vertical rods 8 together with vertical rods 9 carrying a ring 10 of pressing sinkers 4, are mounted for reciprocation in a bearing 11 fixedly connected to the upper needle cylinder 1.

Figure 2:
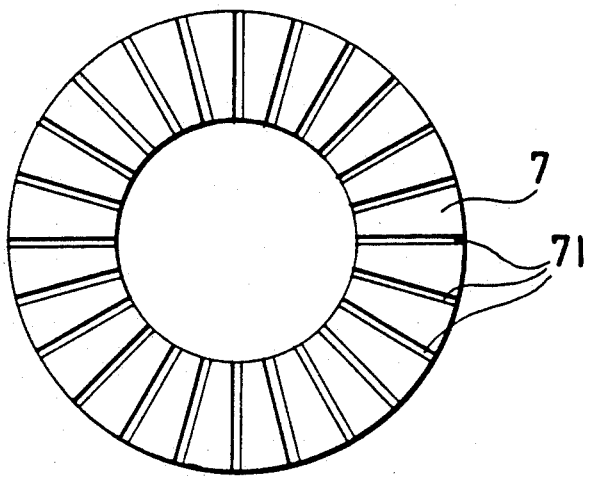
FIG. 2 is a bottom view of the disc provided with radial grooves.
Figure 3:
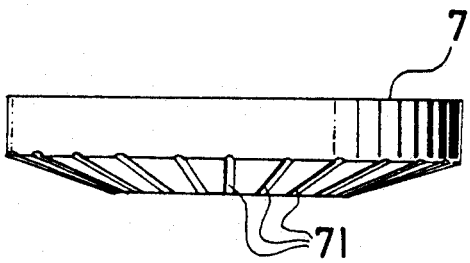
FIG. 3 is a side view of the disc shown in FIG. 2.
Figure 4:
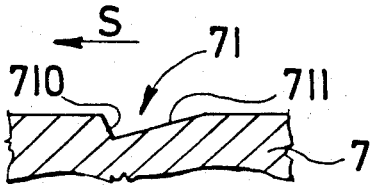
FIG. 4 is a detail view of one radial groove of the disc.

In the lower front surface of the upper takeoff disc 7, that is on its conical front portion facing the helical surface 61 of the lower take-off disc 6, there are provided radial grooves 71 which can be better seen in FIGS. 2 and 3. Said radial grooves 71 are preferably shaped so that they have two edges 710 and 711 (FIG. 4). The edge 710 is substantially perpendicular to the disc front surface while the second edge 711 is inclined and is sloping slowly upwardly in the direction S, opposite to the direction or rotation of the needle cylinders 1 and 2.

The rods 8 and 9 are separately actuated by the control drum of the machine via well-known gearing (not shown).

The take-off device operates as follows:

During the welt knitting the take-off device is at standstill. The upper take-off disc 7 is lifted while the knitwork is being formed and, owing to an inserted elastic thread, displaced toward the middle. After the welt has been finished, the upper take-off disc 7 is brought by a command from the control drum into contact with the lower take-off disc 6 so that the knitwork is forced onto the conical helical surface 61. Then the knitwork is being pressed into said surface 61 so that due to the rotation of disc 6 it is being "screwed" into said surface 61, stretched and withdrawn from the needles. Simultaneously, the knitwork is being pressed into radial grooves by which it is guided in the direction of wales being formed, and prevented from being twisted in accordance with the helix. The knitwork is being safely rolled on the edge 711 into the radial groove 71 while being retained by the edge 710 so that it slides therealong in the vertical direction.

After the knitting has been finished, the upper take-off disc 7 is lifted again by a command from the control drum whereupon the knitwork is knocked-over.

Figure 5:
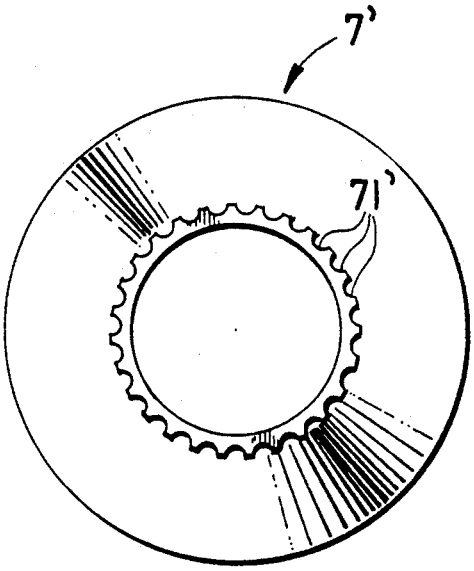
FIG. 5 is a bottom view of another embodiment of the disc provided with radial grooves.
Figure 6:
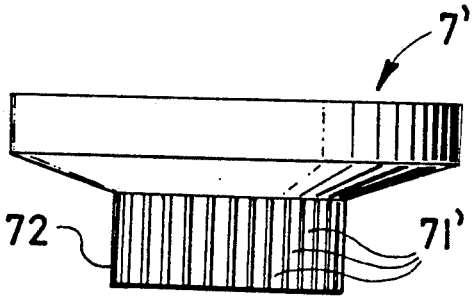
FIG. 6 is a side view of the disc shown in FIG. 5.

Alternatively, according to another aspect of the invention, the upper take-off disc 7' can be made smooth, i.e. its front portion facing the helical surface is without any radial grooves. The radial grooves 71' (FIGS. 5 and 6) are provided in a cylindrical recess 72 extending downward from said disc 7'. Thus the radial grooves 71' bear on the inner cylindrical surface 61' of the lower take-off disc.

During the take-off, the knitwork is being engaged by the radial grooves 71' in the same way as described with the above embodiment so that the knitwork is aligned again in the wale direction.

Within the scope of the present invention it is made possible to provide the radial groves in the lower take-off disc. Similarly the upper disc may be made rotatable while the lower is one stationary, or the like.

What we claim is:

1. In a take-off device for circular knitting machines having a plurality of needles for manufacturing hosiery comprising two discs coacting so as to lead knitwork therebetween, of which one of said discs is stationary and is provided with a helical surface to engage the knitwork being forced thereonto by the other disc which is rotatable, the improvement wherein the rotatable disc (7, 7') has a number of radial grooves (71, 71') on at least a portion of its surface facing the stationary disc (6) to guide the knitwork in a wale direction of the knit hosiery.

2. The take-off device according to claim 1, wherein the number of radial grooves (71, 71') is the same as a number of needles of the knitting machine.

3. The take-off device according to claim 1, wherein the radial grooves (71) extend over the helical surface (61).

4. The take-off device according to claim 1, wherein the radial grooves (71) are provided downstream of the helical surface (51) in a knitwork take-off direction.

5. The take-off device according to claim 1 wherein each of the radial grooves (71) has two edges (710, 711) of which one (711), has a gradual slope, in a direction opposite rotation of a needle cylinder (1, 2) while the other (71) is substantially perpendicular to the surface of the disc (7).

* * * * *